US011602769B2

(12) United States Patent
Richey

(10) Patent No.: US 11,602,769 B2
(45) Date of Patent: Mar. 14, 2023

(54) CORROSION LAMINATE SYSTEM

(71) Applicant: CORROSION LAMINATE SYSTEMS, LLC, Chico, TX (US)

(72) Inventor: Neil Wayne Richey, Chico, TX (US)

(73) Assignee: CORROSION LAMINATE SYSTEMS, LLC, Chico, TX (US)

( * ) Notice: Subject to any disclaimer, the term of this patent is extended or adjusted under 35 U.S.C. 154(b) by 0 days.

(21) Appl. No.: 17/529,943

(22) Filed: Nov. 18, 2021

(65) Prior Publication Data

US 2022/0152650 A1 May 19, 2022

Related U.S. Application Data

(60) Provisional application No. 63/115,439, filed on Nov. 18, 2020.

(51) Int. Cl.

| | |
|---|---|
| ***B05D 7/22*** | (2006.01) |
| ***B05D 3/12*** | (2006.01) |
| ***B05C 7/00*** | (2006.01) |
| ***B05D 1/26*** | (2006.01) |
| ***B05D 7/14*** | (2006.01) |

(52) U.S. Cl.

CPC ..... *B05D 7/227* (2013.01); *B05C 7/00* (2013.01); *B05D 1/26* (2013.01); *B05D 7/14* (2013.01); *B05D 3/12* (2013.01); *B05D 2508/00* (2013.01)

(58) Field of Classification Search

CPC .... B05C 7/00; B05D 1/26; B05D 3/12; B05D 7/22; B05D 7/227; B05D 2508/00; B65D 2590/023; B65D 90/022; C23F 15/00

USPC ..... 106/14.05–14.45; 427/230–239

See application file for complete search history.

(56) References Cited

U.S. PATENT DOCUMENTS

| | | | | |
|---|---|---|---|---|
| 4,022,935 A * | 5/1977 | Kinney | ..... | C09D 133/00 427/236 |
| 4,653,312 A | 3/1987 | Sharp | | |
| 4,670,315 A * | 6/1987 | Hillemeier | ..... | E02D 31/06 427/403 |
| 4,927,476 A | 5/1990 | Watkins | | |
| 7,011,779 B2 | 3/2006 | Fernandes | | |

(Continued)

FOREIGN PATENT DOCUMENTS

| | | |
|---|---|---|
| CN | 106239932 A | 12/2016 |
| CN | 206112328 U | 4/2017 |

(Continued)

OTHER PUBLICATIONS

Campbell, R. "Internal Linings for Vessels and Tanks." Presented at NACE-Jubail Workshop on Coating and Lining for Industrial Applications, Saudi Arabia, May 18, 2014 [online].*

(Continued)

*Primary Examiner* — William P Fletcher, III

(74) *Attorney, Agent, or Firm* — Katten Muchin; Rosenman LLP

(57) ABSTRACT

The corrosion laminate system (CLS) comprises cleaning the produced water (PW) storage tank through debris removal, wet blasting the tank, and drying the tank. The nozzle is inserted and sealed, leaving only the fiberglass portion of the nozzle in contact with the interior of the PW storage tank. The product for sealing the PW storage tank is then applied to the entire interior surface of the tank, the product is cured, and the PW storage tank can be used for storage.

16 Claims, 9 Drawing Sheets

(56) References Cited

U.S. PATENT DOCUMENTS

| | | | |
|---|---|---|---|
| 2001/0002022 | A1 | 5/2001 | Steinbergs et al. |
| 2004/0159657 | A1 | 8/2004 | Chism et al. |

FOREIGN PATENT DOCUMENTS

| | | | | |
|---|---|---|---|---|
| CN | 107738842 | A | | 2/2018 |
| CN | 207696363 | U | * | 8/2018 |
| CN | 111494999 | A | | 8/2020 |
| EP | 2896667 | A1 | | 7/2015 |
| FI | 62994 | B | * | 12/1982 |
| GB | 1522678 | | * | 8/1978 |
| KR | 100923852 | B1 | | 10/2009 |
| WO | 2011110715 | A1 | | 9/2011 |

OTHER PUBLICATIONS

Retrieved from <http://www.nace-jubail.org/Meetings/Internal%20Linings%20for%20Vessels%20and%20Tanks%20%20-%20NACE%20Jubail%20May%202014.pdf > on Aug. 12, 2022. (Year: 2014).*

"Crushed Bottle Glass Blast Abrasive." Industrial Supply, Inc. [online], Apr. 23, 2015. Retrieved from <https://sandblastingabrasives.com/Crushed-Bottle-Glass-Abrasive-Blasting-Media-Crushed-Glass.html> on Aug. 12, 2022. (Year: 2015).*

"Fiberglass Tank Nozzle Repair Services." American Fiberglass Tank Repair [online]. Feb. 9, 2018 Retrieved from <https://web.archive.org/web/20180209234258/http://www.americanfiberglasstank.com/fiberglass-tank-nozzle-repair.htm> on Aug. 12, 2022. (Year: 2018).*

Safety data sheet for STYPOL LSPC-2700 unsaturated polyester, Polynt Composites, May 8, 2020, 7 pages. (Year: 2020).*

International Search Report and Written Opinion dated Feb. 22, 2022, from International Patent Application No. PCT/US2021/059876, 12 sheets.

Xerxes by Shawcor, "Tank Upgrade System", https://www.zcl.com/en/storage-solutions/fuel-tanks/tank-upgrade-system/; Sep. 28, 2020; retrieved from internet: <The Wayback Machine—https://web.archive.org/web/20200928205821/https://www.zcl.com/en/storage-solutions/fuel-tanks/tank-upgrade-system>.

Cibor, "Prevention and repair of leaks in fuel storage tanks", https://www.cibor.be/en/repair-techniques/prevention-and-repair-of-leaks-in-fuel-storage-tanks/; Aug. 14, 2016; retrieved from internet: <The Wayback Machine—https://web.archive.org/web/20160814143246/https://www.cibor.be/en/repair-techniques/prevention-and-repair-of-leaks-in-fuel-storage-tanks/>.

"Installation Procedure for Underground Petroleum Tanks (US)"; uploaded by ZCL Xerxes on Oct. 18, 2017; YouTube Video, https://youtu.be/fDwjDxg87dM.

* cited by examiner

CORROSION LAMINATE SYSTEM

CROSS-REFERENCE TO RELATED APPLICATIONS

This application claims priority to U.S. Provisional Application Ser. No. 63/115,439, filed Nov. 18, 2020, the entire contents of which are hereby incorporated by reference in their entirety.

FIELD OF THE INVENTION

The present invention discloses a corrosion laminate system for use in storage tanks. More particularly, the present invention discloses a corrosion laminate system for extending the life of produced water (PW) storage tanks.

BACKGROUND

In order for a well to produce either oil or natural gas, brine/production/salt water (PW) must be removed from the well bore in order to produce the oil or natural gas. This "brine," or produced water (PW), is the byproduct of production and is stored in temporary storage tanks. Once the PW storage tanks become full, the PW is either pumped into and removed via trucks or pumped to a saltwater disposal. The PW is highly concentrated salt water that has microorganisms in it which causes extreme corrosion to take place within the PW storage tanks over the course of time. Currently, treatments exist for preserving the well bore which include corrosion inhibitors to make the piping in the well last longer. There is currently no treatment for the PW storage tanks and the PW storage tanks corrode over time and produces deterioration within the PW storage tanks.

The PW storage tanks range in size from 210-500 BBL (barrels) tanks since they are used to temporarily hold the PW until it is removed. A well can produce 1-300 BBL a day, depending on the well.

The PW storage tank generally comprises an internal containment system to protect from environmental spills. The challenge as indicated previously is that the corrosion breaks down then containment system and holes are created, resulting in PW leaks. This creates a major environmental issue when the PW storage tanks leak. The PW destroys the soil and kills any vegetation resulting in very costly remediation that can take a very long time to reverse the damage. A spill can cost anywhere from $5,000-$500,000 if no public waterway has been affected. If any public or running water way is effected, the cost can rises exponentially. PW storage tanks are failing every day and the environmental effect and urgency is becoming greater every year.

The cost to replace or repair the PW tanks today is roughly $15,000-$20,000 dollars per PW tank and can lead to production down time. Therefore, a need clearly exists for a less expensive system and method for extending the life of the PW tanks beyond the normal life expectancy today with the current solutions. The following describes such a system and method well-suited PW disposal sites that is both cost-effective and environmentally friendly.

SUMMARY

The present invention describes a corrosion laminate system and a nozzle for use with the CLS. CLS involves cleaning the PW storage tank through debris removal, wet blasting the tank, and drying the tank. The nozzle is inserted and sealed, leaving only the fiberglass portion of the nozzle in contact with the interior of the PW storage tank. The product for sealing the PW storage tank is then applied to the entire interior surface of the tank, the product is cured, and the PW storage tank can be used for storage.

DETAILED DESCRIPTION

The only current solution for replacing PW storage tanks involves disconnecting all connections/fittings, removing the damaged tank, washing the tank, and removing it from the site. A new PW storage tank is then put in place, requiring the reconnection of the pipes. This comes at a great cost to the operator and most of these existing tanks have naturally occurring radioactive material (NORM) which has to go into a landfill, thus creating more damage to the environment. While the new PW storage tank which replaced the corroded tank will repeat this same process that has been in place over a hundred years. Most companies, because of the cost, wait until failure because they can't afford to remove them. An alternative is to pull the tank out of service, remove it from the job site, weld patches to cover corroded areas and paint the inside with an epoxy to slow this process down. The epoxy coating fails when the paint cracks and all the corrosion is concentrated to one spot. The epoxy coating system will usually add additional years to the tank if conditions are adequate, but is reliant on the steel being thick enough to apply. The issue with relying on this bond is for the bonding agents to work the tank must be blasted white and this can only be done using dry media with sufficient metal to blast into. None of this is possible in place without removing the PW storage tank from the job site. Still this can cost more than that of buying a new tank and repeating this same process.

Corrosion Laminate System (CLS)

Figure 1:
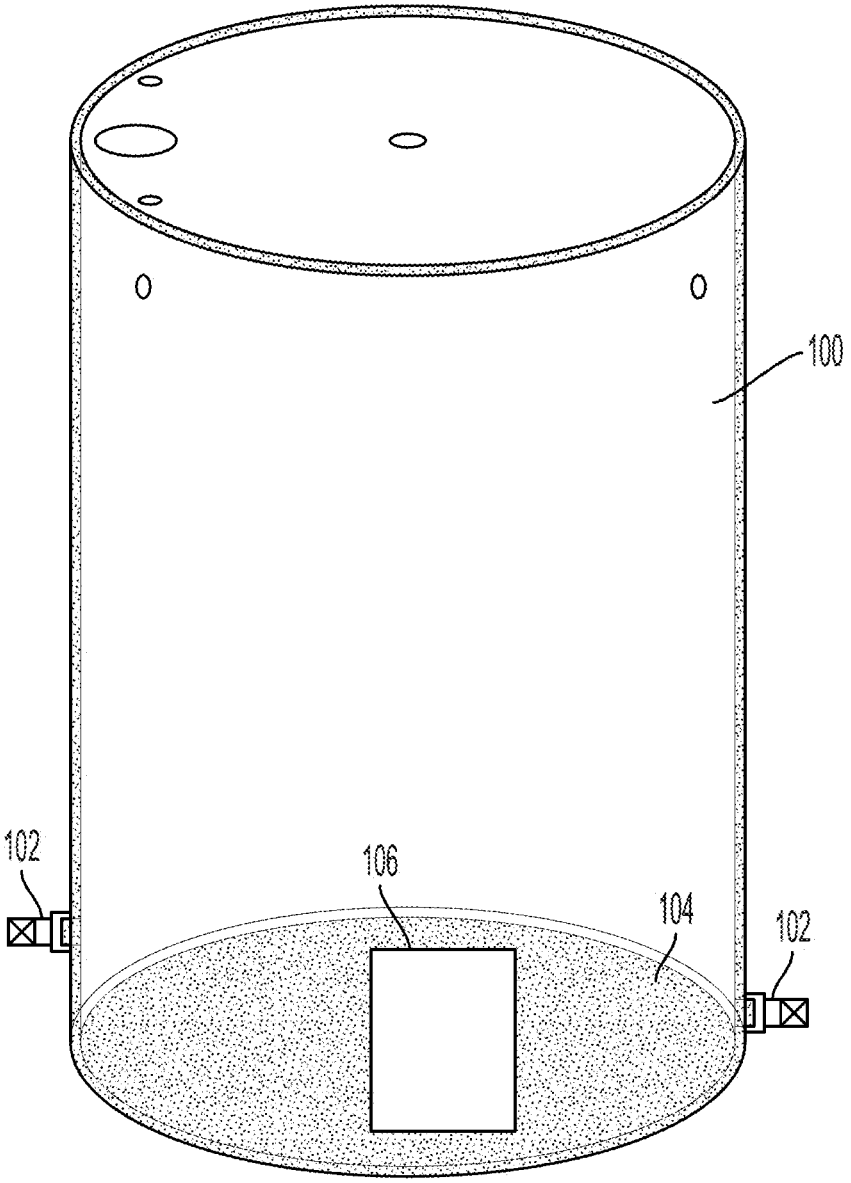
FIG. 1 depicts a view of a PW storage tank to which the Corrosion Laminate System (CLS) is applied.
Figure 2:
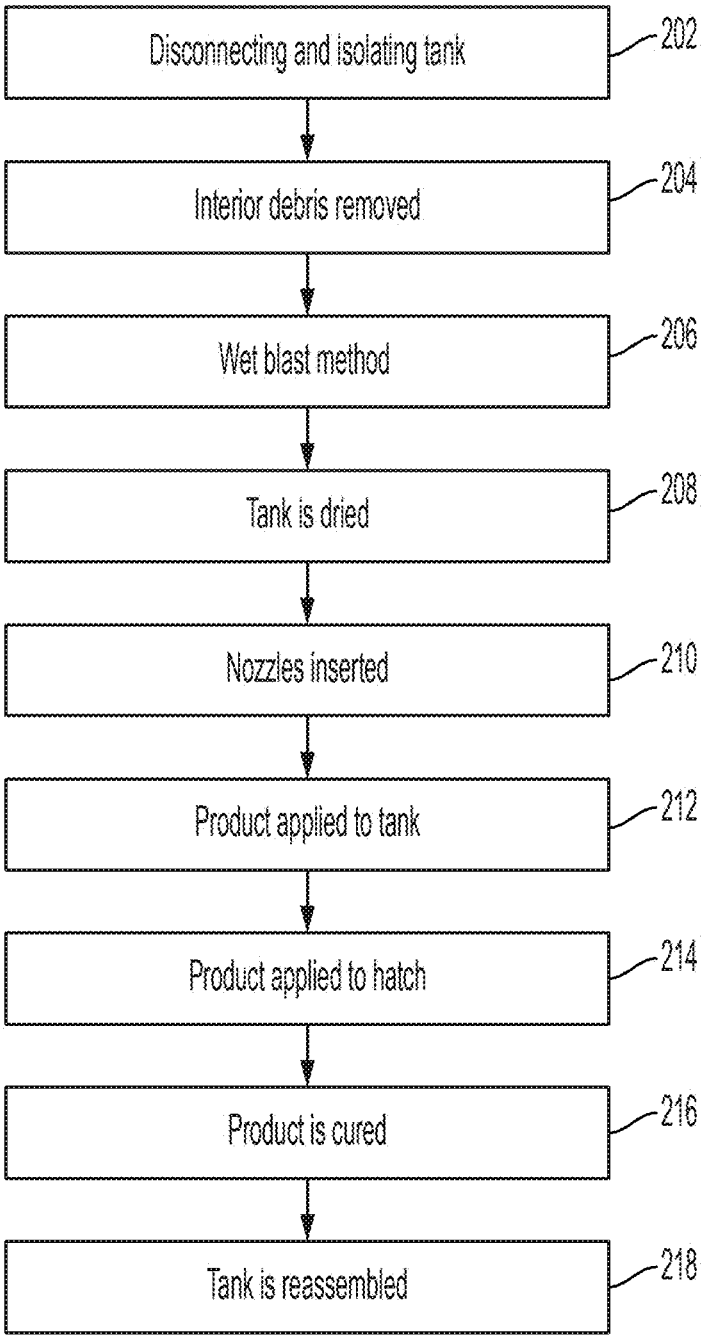
FIG. 2 is a flowchart showing the steps used in the CLS.

Disclosed herein is a CLS for allowing on-site patching and refurbishment of PW storage tanks 100 without holes in them and allowing for the tank to be placed back in service in a timely manner. A perspective view of a PW storage tank 100 is depicted in FIG. 1. The steps of the CLS are depicted in FIG. 2.

First, PW storage tank 100 is disconnected and isolated in-place without any need to lift or remove PW storage tank 100 in step 202. The original upper and lower nozzles 102 are both disconnected in step 202.

The interior debris of PW storage tank 100 is removed in step 204. A wet blast method is used in step 206 to clean the tank surfaces. The wet blast method uses water and crushed recycled ecofriendly glass to remove scaling and rust from the inner sides of PW storage tank 100. This wet blast method is used because it prevents the generation of any heat or sparks which creates a fire hazard on the job site.

The PW storage tank 100 is left to dry overnight in step 208. Within 24 hours, a quick inspection of all surfaces of PW storage tank 100 is completed. Upon having a clean and dry environment, nozzle inserts 102 are inserted into key outlets of PW storage tank 100 we next insert nozzles in key outlets in step 210.

Figure 3:
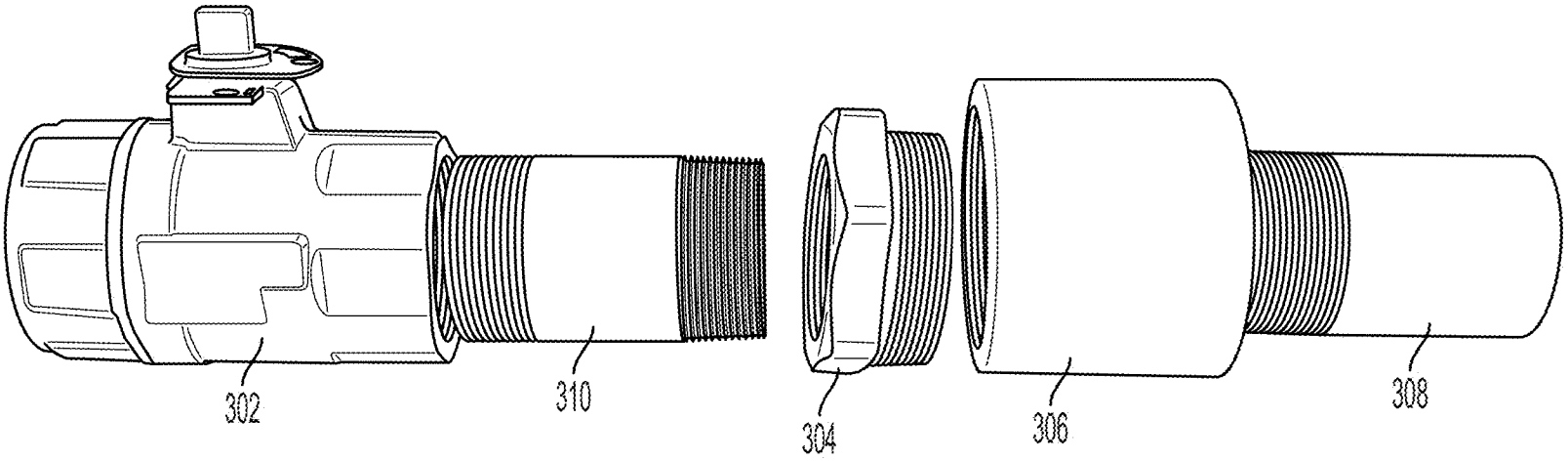
FIG. 3 depicts an exploded view of the nozzle for use with the CLS.
Figure 4:
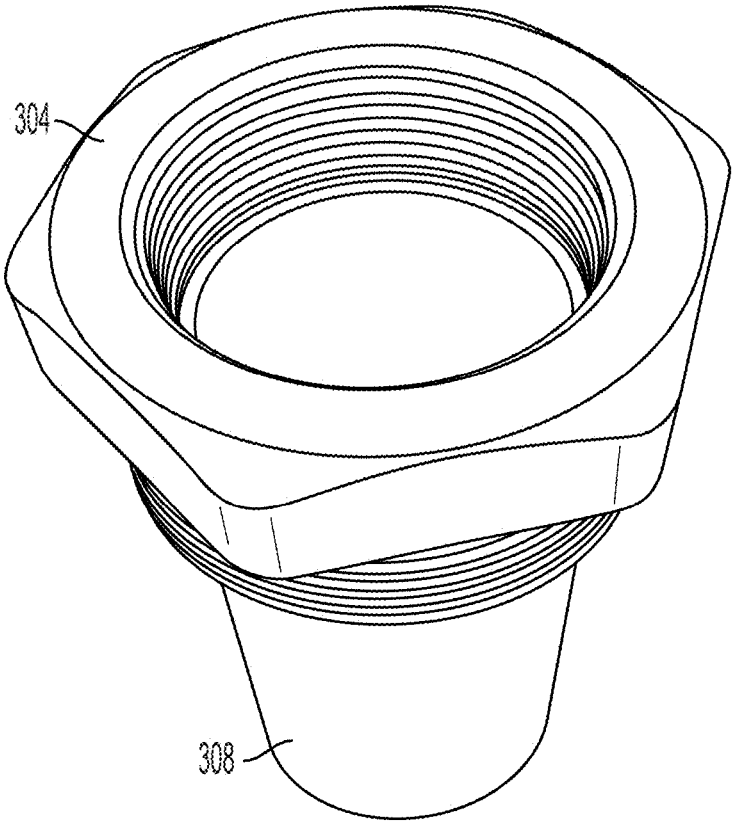
FIG. 4 depicts a view of the coupling of the fiberglass nipple to the double tapped bushing.
Figure 5:
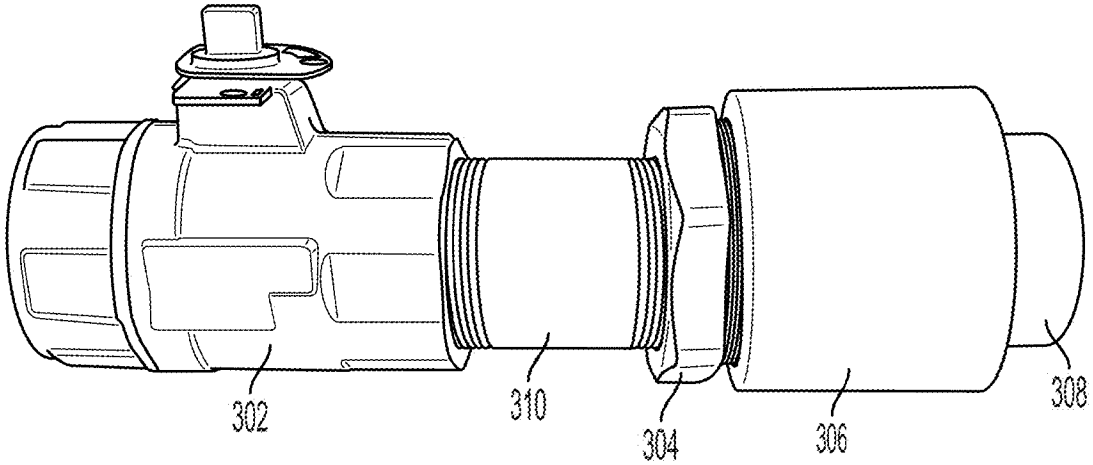
FIG. 5 depicts a view of the nozzle pieces of FIG. 3 fully assembled.

Referring next to FIGS. 3-5, depicted are views of nozzle insert 102. Nozzle insert 102 generally comprises tank valve 302, double tapped bushing 304, tank coupling 306, and fiberglass nipple 308. The fiberglass nipple 308 is molded to the laminate system to remove any bonding issues with PW storage tank 100. The exterior of double tapped bushing 304 is used to then insert a steel nipple 310 and valve 302 for service work and pulling loads of fluid.

Nozzle insert 102 is important for testing for durability purposes. Using a single fiberglass nipple 308 and inserting it into the exterior of the nozzle and bonding it to the system may not be successful. Nozzle insert 102 allows for the usage of tank valve 302 on the exterior of PW storage tank 100 with fiberglass nipple 308 being used on the interior. Fiberglass nipple 308 is the only portion of nozzle insert 102 that is in contact with the interior of the PW storage tank 100. A first end of fiberglass nipple 308 resides within the interior of the PW storage tank 100 and a second end of fiberglass nipple 308 extends outside the PW storage tank 100. Tank coupling 306 is permanently coupled to the second end of fiberglass nipple 308 on the exterior of the PW tank and helps to provide a seal with the interior of the PW tank. Double tapped bushing 304 is able to withstand constant reattachment of hoses and other valves on the outside of PW storage tank 100, leading to less failure.

Referring back to FIG. 2, after nozzle inserts 102 are placed and the second end of fiberglass nipple 308 is in place in the interior of PW storage tank 100, a fiberglass chop gun is used to apply a polyester/vinyl ester resin to all interior surface of PW storage tank 100 in step 212, including in and around fiberglass nipple 308 to create an interior seal with no exposed metal on the interior of PW storage tank 100.

Preferably the resin is a polyester general purpose resin LSPC 2700-DT Stypol® with a MEKP (Methyl Ethyl Ketone Peroxide) hardener at 2-3% ratio. Fiberglass is mixed with the resin to form the product 104 for application. The polyester resin may be kept at a temperature of 60° F. or greater during application. Barrel heaters and line heaters may be used to control the product 104 when temperature is a combating factor.

The MEKP hardener may be reduced to a 1% ratio. However, this will increase curing times and require more than one day for multiple layers of the product to be applied to PW storage tank 100. In the summer, faster cure times with 1% MEKP may be achieved, but GEL time may be increased during summer months in some cases but is not recommended due to the gel time. GEL Time is the time it takes for the resin to get tacky so that another layer can be applied.

If the product 104 has to be finished at a later date, the bond between the two laminates may be compromised unless it is sanded down so the new resin can adhere creating an issue with cost and time out of service as well as hot work that cannot be performed with the tank in place. Therefore, it is preferable that all layers of product 104 are applied in immediate succession to avoid the need for sanding.

In some embodiments, vinyl ester resin may be used instead of the polyester resin. However, vinyl ester resin is typically 2-3 times the cost. During step 212, the product is applied to the interior walls and floor of PW storage tank 100 as well as nozzle inserts 102. The product 104 is preferably applied until it is ⅛"-¼" in thickness. This thickness is sufficient to provide structure and strength for PW storage tank 100 to be reused and to prevent cracking. This reinforces structure areas while allowing the PW storage tank 100 to flex as conditions change.

The thickness of product 104 may be greater than ¾" if needed. However, this will reduce the interior volume of PW storage tank 100. PW storage tank 100 volume is determined by barrels per foot and changing that wall thickness greater than ¾" will change the gauging of the volume per foot and can result in a reject of a load of oil as well as saltwater contracted to be hauled by the barrel. New PW storage tanks 100 typically have walls with a thickness of 3/16" and a floor thickness of ¾". By applying the product 104 ⅛"-¼" in thickness, the volume capacity of each PW storage tank 100 is maintained within acceptable tolerances.

PW storage tank 100 is not a static holding tank at all times and pressure within the tank can change when venting the well to the tank and pressure is increased. The top of PW storage tank 100 preferably only receives a partial laminate around the edges and weld seams to allow for proper bonding. However, the top of PW storage tank 100 can receive a full laminate coating.

After the product 104 has been applied to PW storage tank 100, the product 104 is applied to manway hatch 106 in step 214. The product 104 is left to cure for 8-24 hours in step 216. The curing process can vary depending on humidity and temperature. After reinsertion, the PW storage tank is reassembled in step 218 and all connection/fittings are put back into place, making PW storage tank 100 operational.

The process depicted in steps 202-218 essentially creates a new storage tank within PW storage tank 100. By creating a standalone tank inside the existing tank that the fluid will now reside in all the way to the valves installed on the exterior of the tank, the exposure of the PW to the metal from the inside is eliminated, thereby extending the life of the tanks. This entire process is completed within 3 business days absent external issues such as weather, etc. and allows for production to resume in a timely and cost-effective manner.

Art coatings for PW storage tanks 100 generally relied on the structure of the steel to hold form after they are applied. In order to protect the shell, the coatings have to have complete bond on the entire surface area including to nozzles. However, the coatings can fail at the and on regular occasion fail on the surface area of the tank. The reason that both fail at the nozzle is because they can't completely coat the nozzle (made of metal) protecting it from corrosion thus all of the corrosion is concentrated at the nozzle actually causing the tank to fail faster than if it had no coating at all.

If the interior of PW storage tank 100 was not coated at all, bacteria and rust would be spread over the entire interior. By leaving a metal nozzle nipple on the interior of PW storage tank 100, all the corrosion is concentrated at a single point of failure and causes the tank to corrode at a much higher rate and a pin hole opening can open at the nozzle. The nozzle 102 of the present invention addresses this issue by carrying the protection from corrosion though the nozzle to the exterior of the tank. The exterior portions of nozzle 102 can be replaced as needed whereas fiberglass nipple 308 needs no replacement after coating by the corrosion laminate system of the present invention.

Figure 6:
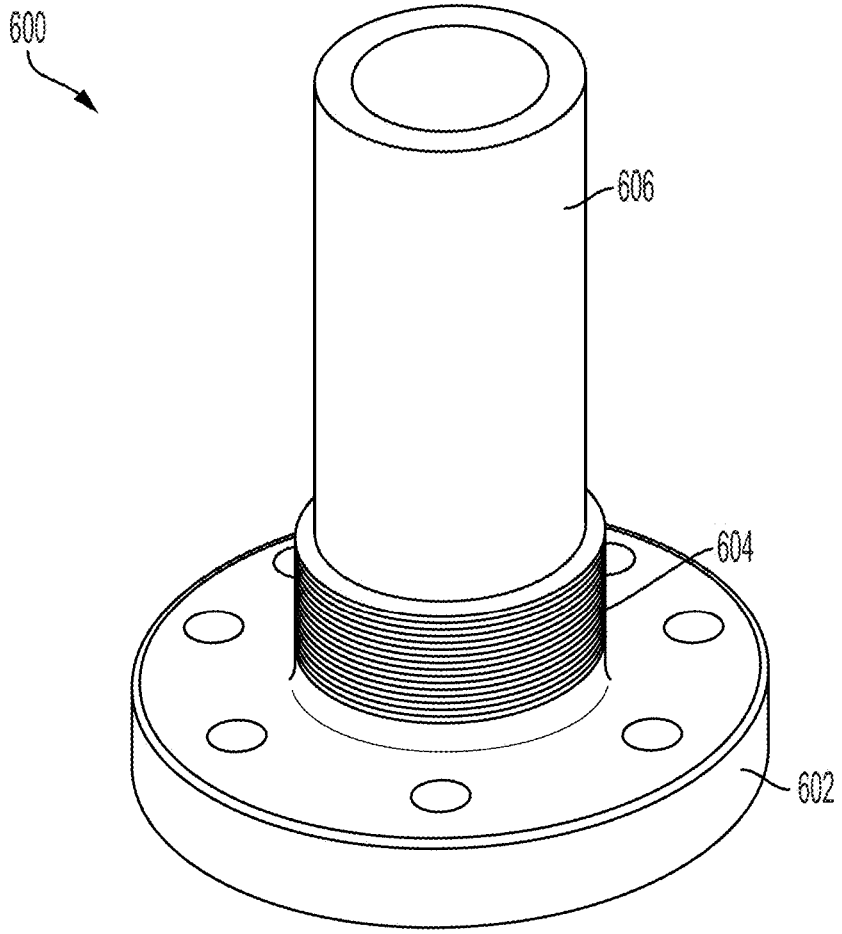
FIG. 6 depicts an alternate embodiment of the fiberglass nipple of FIG. 4
Figure 7:
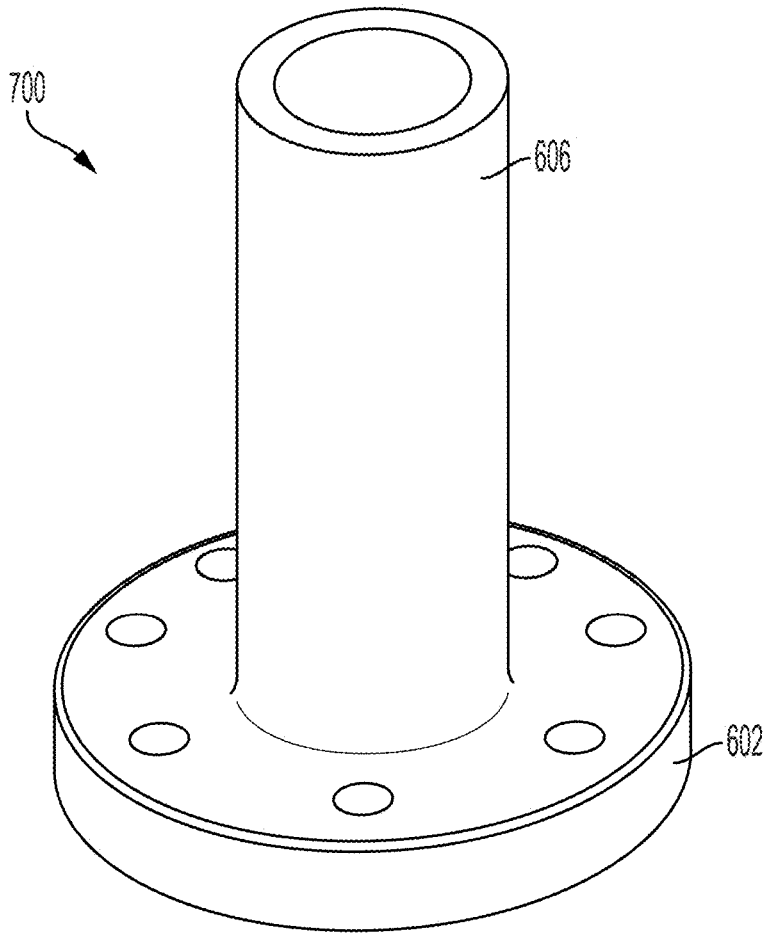
FIG. 7 depicts another alternate embodiment of the fiberglass nipple of FIG. 4.

PW storage tanks 100 generally have flanged or threaded inserts. Nozzle 102 depicted in FIGS. 3-5 is designed to attached to a PW storage tank 100 having a threaded collar. Alternate embodiments of fiberglass nipple 308 are depicted in FIGS. 6-7. Fiberglass nipple 600 in FIG. 6 comprises flange 602, threaded portion 604, and cylindrical shaft 606. Fiberglass nipple 600 is designed to convert PW storage tanks 100 having a threaded connection to one having an exterior flange connection. Threaded portion 604 is attached to the threaded collar of the PW storage tank 100 (e.g., tank coupling 306). Any exterior parts of nozzle 102 can then be attached to flange 602.

Figure 8:
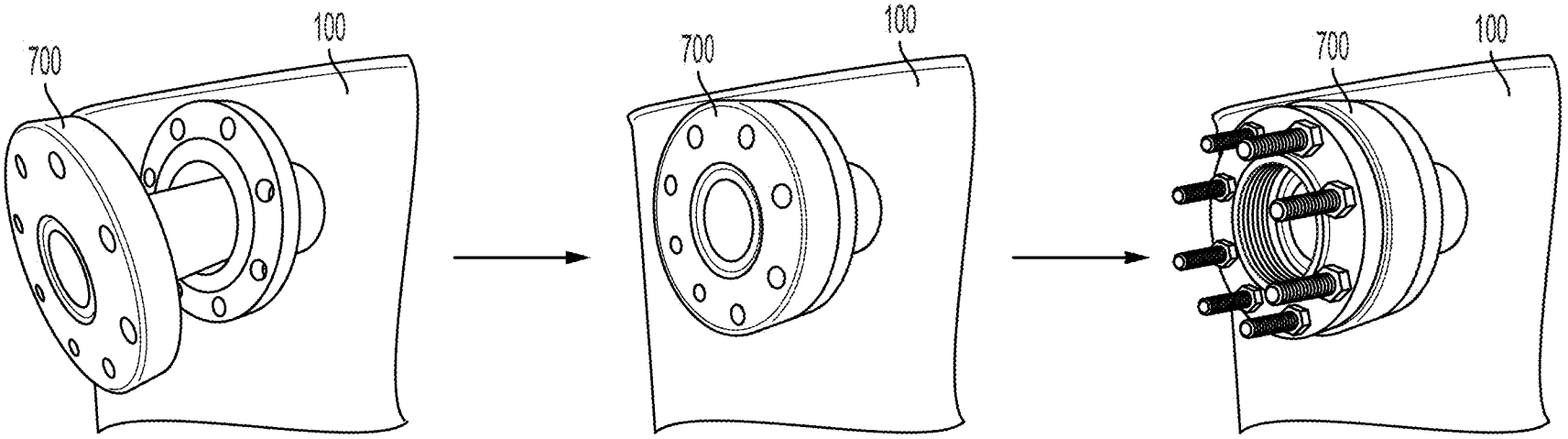
FIG. 8 depicts a view of the fiberglass nipple of FIG. 6 being inserted into a PW storage tank.
Figure 9:
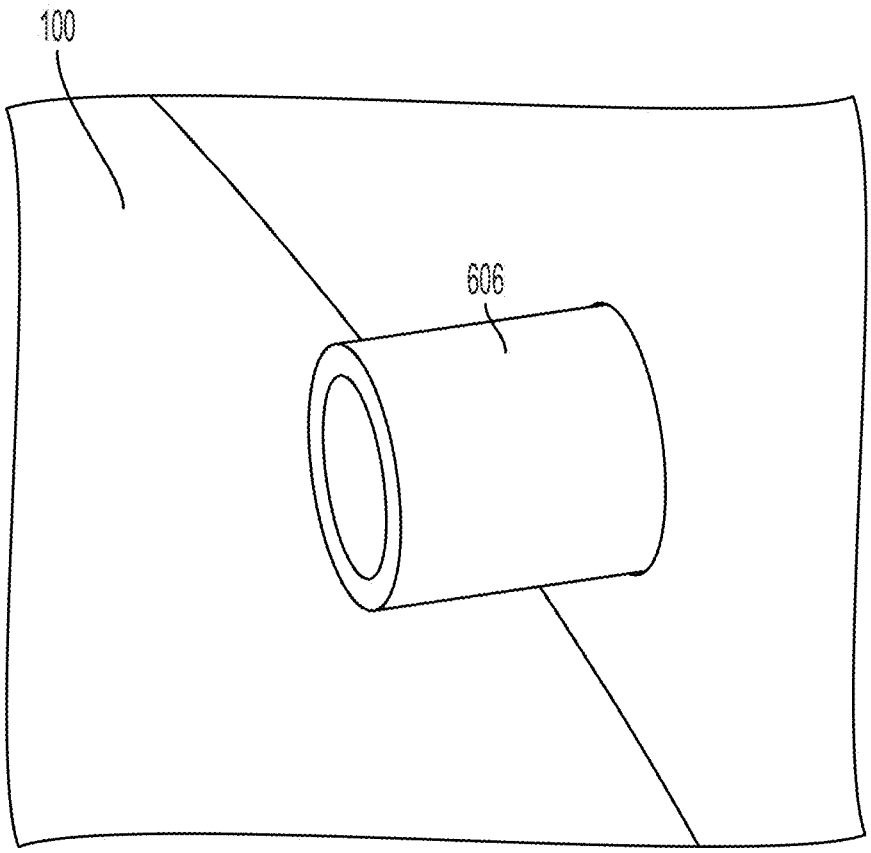
FIG. 9 depicts a view of the fiberglass nipple of FIG. 6 from an interior of the PW storage tank.

FIG. 7 depicts fiberglass nipple 700 which is substantially similar to fiberglass nipple 600 with the absence of threaded portion 604. Fiberglass nipple 700 is designed to be used when PW storage tank 100 has a flange connection for the nozzle 102 as depicted in FIG. 8. Cylindrical shaft 606 is inserted into the flange opening on PW storage tank 100 and bolts are placed through flange 602 to join it to the corresponding flange on the PW storage tank 100. The only portion of nozzle 102 exposed to the interior of the tank is cylindrical shaft 606 as depicted in FIG. 9

Like fiberglass nipple 308, fiberglass nipple 600 and fiberglass nipple 700 are inserted into the PW storage tank in step 210 before the product is applied to the interior of the tank. This forms a seal between the exterior of the cylindrical shaft 606 and the surrounding portions of the interior of PW storage tank 100, leaving only the fiberglass portion of nozzle 102 exposed to the contents of the interior of PW storage tank 100. As previously discussed, the use of fiberglass only on the interior prevents a single point of failure from forming around the nozzle 102 and greatly extends the life of PW storage tank 100.

Fiberglass nipples 308, 600, and 700 are preferably formed entirely of fiberglass from one or more pieces that are coupled together. By making these pieces out of fiberglass instead of a metal, the aforementioned corrosion problems at the nozzle 102 can be avoided.

While specific embodiments of the invention have been described above, it will be appreciated that the invention may be practiced other than as described. The embodiment(s) described, and references in the specification to "one embodiment," "an embodiment," "an example embodiment," "some embodiments," etc., indicate that the embodiment(s) described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is understood that it is within the knowledge of one skilled in the art to effect such feature, structure, or characteristic in connection with other embodiments whether or not explicitly described.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The invention claimed is:

1. A method of applying a corrosion laminate comprising:
wet blasting interior surfaces of a storage tank;
drying the interior surfaces;
inserting nozzle inserts into the storage tank after drying;
applying a product to the interior surfaces of the storage tank to create an interior coating and seal; and
curing the product for 8-24 hours,
wherein each nozzle insert comprises a fiberglass nipple in contact with an interior of the storage tank after the nozzle inserts are inserted.

2. The method of claim 1, wherein the wet blasting uses a combination of water and crushed glass to remove scaling and rust.

3. The method of claim 1, wherein the product comprises a polyester resin mixed with a Methyl Ethyl Ketone Peroxide hardener at 1-3% ratio.

4. The method of claim 1, further comprising:
applying a partial coating and seal to only edges and weld seams of a top interior surface of the storage tank.

5. The method of claim 1, wherein the coating and seal is applied uniformly to side surfaces and a bottom surface of the storage tank.

6. The method of claim 1, wherein the coating and seal is applied to all interior surfaces of the storage tank so no metal surfaces are left exposed on the interior of the storage tank.

7. The method of claim 1, wherein the fiberglass nipple is the only element of each nozzle insert in contact with the contents of the storage tank in the interior of the storage tank.

8. The method of claim 7, wherein the coating and seal is applied around an exterior of each fiberglass nipple to form a seal.

9. The method of claim 1, wherein each fiberglass nipple comprises:
a tubular cylindrical section;
a threaded section; and
an exterior flange,
wherein the threaded section is coupled to a threaded opening on an exterior of the storage tank, and
wherein the flange is coupled to exterior components of the nozzle insert outside the storage tank.

10. The method of claim 9, wherein the product is applied to an exterior of the tubular section on the interior of the storage tank to form an interior seal.

11. The method of claim 9, wherein the fiberglass nipple is wholly formed from fiberglass.

12. The method of claim 1, wherein each fiberglass nipple comprises:
a tubular cylindrical section;
an exterior flange,
wherein the exterior flange is coupled to an exterior flange of the storage tank to join the nozzle insert to the storage tank, and
wherein the flange is coupled to exterior components of the nozzle insert outside the storage tank.

13. The method of claim 12, wherein the product is applied to an exterior of the tubular cylindrical section on the interior of the storage tank to form an interior seal.

14. The method of claim 12, wherein the fiberglass nipple is wholly formed from fiberglass.

15. The method of claim 1, wherein the product is applied until the coating is ⅛"-¾" in thickness on the interior surfaces.

16. The method of claim 1, wherein the product comprises a vinyl ester resin mixed with a Methyl Ethyl Ketone Peroxide hardener at 1-3% ratio.

* * * * *